US009211735B2

(12) United States Patent
Yangishita et al.

(10) Patent No.: US 9,211,735 B2
(45) Date of Patent: Dec. 15, 2015

(54) TRAY AND INK JET TEXTILE-PRINTING APPARATUS

(71) Applicant: SEIKO EPSON CORPORATION, Tokyo (JP)

(72) Inventors: Kenji Yangishita, Matsumoto (JP); Hideyuki Takeuchi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 77 days.

(21) Appl. No.: 13/790,187

(22) Filed: Mar. 8, 2013

(65) Prior Publication Data

US 2013/0278695 A1 Oct. 24, 2013

(30) Foreign Application Priority Data

Apr. 18, 2012 (JP) ..... 2012-094524

(51) Int. Cl.

| | |
|---|---|
| ***B41J 2/01*** | (2006.01) |
| ***B05C 17/06*** | (2006.01) |
| ***B41J 11/02*** | (2006.01) |
| ***B41J 3/407*** | (2006.01) |
| ***B41J 11/06*** | (2006.01) |

(52) U.S. Cl.

CPC ..... *B41J 11/02* (2013.01); *B41J 3/4078* (2013.01); *B41J 11/06* (2013.01)

(58) Field of Classification Search

CPC ..... B41J 3/4078; B41F 15/34

See application file for complete search history.

(56) References Cited

U.S. PATENT DOCUMENTS

| | | | | |
|---|---|---|---|---|
| 4,672,747 | A * | 6/1987 | Turner | 33/1 K |
| 6,651,554 | B1 * | 11/2003 | Williams | 101/126 |
| 7,040,748 | B2 | 5/2006 | Niimi et al. | |
| 7,237,890 | B2 | 7/2007 | Niimi et al. | |
| 7,413,301 | B2 | 8/2008 | Niimi et al. | |
| 2004/0179081 | A1 | 9/2004 | Nimi et al. | |
| 2006/0152568 | A1 | 7/2006 | Niimi et al. | |
| 2006/0203069 | A1 | 9/2006 | Niimi et al. | |
| 2007/0200907 | A1 * | 8/2007 | Kuki et al. | 347/104 |
| 2010/0051682 | A1 * | 3/2010 | Ichikawa et al. | 235/375 |

FOREIGN PATENT DOCUMENTS

| | | |
|---|---|---|
| JP | 2004-284305 | 10/2004 |

* cited by examiner

*Primary Examiner* — Shelby Fidler
*Assistant Examiner* — Tracey McMillion
(74) *Attorney, Agent, or Firm* — Workman Nydegger

(57) ABSTRACT

A tray includes a main body having a setting surface to set a material to be textile-printed, a frame portion that is fit in the main body in a state of setting the material to be textile-printed on the setting surface, and maintains the setting state of the material to be textile-printed, and a setting guide display that is provided in the frame portion and used as a criterion at the time of determining a setting position of the material to be textile-printed on the main body. A plurality of setting guide displays are provided in the frame portion.

22 Claims, 10 Drawing Sheets

TRAY AND INK JET TEXTILE-PRINTING APPARATUS

BACKGROUND

1. Technical Field

The present invention relates to a tray used in a case of setting fabric, namely a material to be textile-printed, and an ink jet textile-printing apparatus which executes a printing process using the tray.

2. Related Art

An ink jet textile-printing apparatus which prints a desired image through discharging ink of each color on a surface of a fabric, such as a T-shirt, using an ink discharge head has been developed and widely used.

In this case, a setting/fixing work in which a fabric to be printed is positioned and fixed at a predetermined setting position on a main body of a tray is performed before a printing process. Hitherto, the setting/fixing work has been carried out by determining the setting position of the fabric using the sense of a user while the user checks a relative position between the fabric to be set and the main body with his or her eyes.

In addition, the fabric capable of being printed by the ink jet textile-printing apparatus includes a fabric having a relatively small size, such as gloves or socks, aside from a fabric having a relatively big size, such as a T-shirt. When such a small fabric is set on the main body, it is difficult to perform a setting process of the setting position of the fabric.

Therefore, JP-A-2004-284305 discloses the configuration where a second platen used at the time of performing printing with respect to the small fabric, such as gloves or socks. According to the configuration, the second platen facilitates the setting work with respect to the small fabric, such as gloves or socks, whereby the unevenness of the setting position of the fabric is suppressed.

However, in the case of setting the small fabric, such as gloves or socks, using the second platen, the setting process of the setting position of the fabric is not performed precisely because a user determines the relative position between the fabric to be set and the second platen without using any criterion except his or her sense.

Also, the small fabric to be printed by the ink jet textile-printing apparatus also includes one in the shape of sheet such as a handkerchief, but it is unable to use the second platen at the time of setting such a small sheet-shaped fabric on the main body. Therefore, the size difference between the fabric to be set and the main body is great in this case, whereby it is more difficult to perceive the relative position therebetween.

On the other hands, in the case of setting the fabric having a size bigger than that of the main body on the main body, when such a large fabric is set on the main body, the main body is covered with the large fabric. Therefore, it is also difficult to perceive the relative position between the fabric to be set and the main body.

Furthermore, in the case of printing a small image on a part of the fabric by one point, the size of the image to be actually printed is too small with respect to a feasible printing area, whereby there is a problem that the setting of the printing position of the image with respect to the fabric is difficult to be performed.

SUMMARY

An advantage of some aspects of the invention is to provide a tray making it easy to set a setting position of a material to be textile-printed with respect to a main body thereof, and an ink jet textile-printing apparatus which executes a printing process using the tray.

According to an aspect of the invention, there is provided a tray including: a main body having a setting surface to set a material to be textile-printed; a frame portion that is fit in the main body in a state of setting the material to be textile-printed on the setting surface, and maintains the setting state of the material to be textile-printed; and a setting guide display that is provided in the frame portion and used as a criterion at the time of determining a setting position of the material to be textile-printed on the main body.

In this case, "material to be textile-printed" means "cloth" that is a target to be textile-printed. The cloth includes natural fibers such as cotton, silk and wool, synthetic fibers such as nylon, or woven, knitted or non-woven fabric of composite fibers mixed with these fibers. Also, the cloth includes both of lengthy material wound in a roll shape and material cut in a predetermined length. In addition, the cloth also includes clothing such as a sewed T-shirt, a sewed handkerchief, scarf, towel or the like, or cloth or the like to be cut or have been cut which is a part to be sewn.

Among the examples of the cloth, "material to be textile-printed" having a body portion in a tubular shape, such as a T-shirt, is a main target in the aspect of the invention.

According to the aspect of the invention, the setting guide display used as the criterion at the time of determining the setting position of the material to be textile-printed on the main body is provided in the frame portion. Thereby, it is possible to objectively perform the determination of the relative position between the material to be textile-printed and the main body, which, in a related art, has been carried out by a user with their senses, using the setting guide display.

In addition, according to the aspect of the invention, the setting guide display is provided in the frame portion which is not covered with the material to be textile-printed even when the material to be textile-printed having a size bigger than that of the main body is used. Therefore, it is possible to improve a setting property corresponding to the material to be textile-printed having a various sizes or shapes.

Therefore, a setting process of the setting position of the material to be textile-printed with respect to the tray becomes easier than the manner in a related art, whereby it is possible to precisely perform the setting process of the setting position, compared to the conventional manner. Furthermore, it is possible to improve the setting property corresponding to the material to be textile-printed having a various sizes or shapes.

In the tray, it is preferable that a plurality of setting guide displays are provided in the frame portion.

According to the aspect of the invention, since the plurality of setting guide displays are provided in the frame portion, the number of displays which are used as a criterion at the time of determining the setting position of the material to be textile-printed on the main body increases. Thereby, the setting process of the setting position of the material to be textile-printed with respect to the tray becomes much easier, whereby it is possible to more precisely perform the setting process of the setting position.

In the tray, it is preferable that, in the plurality of setting guide displays, at least two setting guide displays are provided in the frame portion so as to face each other.

According to the aspect of the invention, in the plurality of setting guide displays, at least two setting guide displays are provided in the frame portion so as to face each other. Due to the facing disposition, it is possible to easily perceive a deviation of the setting position of the material to be textile-printed with respect to the main body.

In the tray, it is preferable that the frame portion has a plurality of frame elements constituting the frame portion and the setting guide display is provided at a central position of each frame element.

In this case, "central position of the frame element" is a middle position of the frame element in a longitudinal direction.

According to the aspect of the invention, the setting guide display is provided at the central position of each frame element facing each other. Thereby, it is possible to more easily perceive the deviation of the setting position of the material to be textile-printed with respect to the main body.

Furthermore, if the configuration has a feature in which the frame portion has a rectangular shape and a single mark is provided, as the setting guide display, at the central position of the front, rear, left and right frame elements of the frame portion having a rectangular shape, it is possible to perceive, using a very simple structure, the deviation of the setting position of the material to be textile-printed with respect to the main body.

In the tray, it is preferable that the frame portion has the plurality of frame elements constituting the frame portion, and the setting guide display is provided at the position on the frame element where the frame element is equally divided in a predetermined direction.

According to the aspect of the invention, the setting guide display is provided at the position on the frame element where the frame element is equally divided in the predetermined direction. Thereby, it is possible to more objectively and precisely perform the determination of the relative position between the material to be textile-printed and the main body.

In the tray, it is preferable that the setting guide display is a scale display formed on the frame portion.

According to the aspect of the invention, as similar to the aspect described above, the setting guide display is provided in the frame portion which is not covered with the material to be textile-printed even when the material to be textile-printed having a size bigger than that of the main body is used, whereby it is possible to cope with the material to be textile-printed having a various sizes or shapes.

Furthermore, since the scale display formed on the frame portion constitutes the setting guide display, it is possible to precisely measure the setting position of the material to be textile-printed. Thereby, it is possible to further objectively perform the determination of the relative position between the material to be textile-printed and the main body.

In the tray, it is preferable that a rotary arm capable of rotating on an inward side and outward side of the frame portion is provided in the frame portion, and the setting guide display is a scale display formed on the rotary arm.

According to the aspect of the invention, as similar to the aspect described above, the setting guide display is provided in the rotary arm which is not covered with the material to be textile-printed even when the material to be textile-printed having a size bigger than that of the main body is used. Therefore, it is possible to provide the tray having an excellent setting property corresponding to the material to be textile-printed having a various sizes or shapes.

Furthermore, the scale display is formed on the rotary arm capable of rotating on the inward side and outward side of the frame portion, whereby, in the case of confirming the setting position of the material to be textile-printed having a size smaller than that of the main body or the printing position of an image, it is possible to precisely measure and perceive the position thereof by rotating the rotary arm on the inward side of the frame portion. On the other hand, in the case of performing the setting process of the setting position of the material to be textile-printed having a size bigger than that of the main body, it is possible to easily and precisely perform the setting process by rotating the rotary arm on the outward side of the frame portion and measuring a protrusion amount of the material to be textile-printed from the main body.

In the tray, it is preferable that a tape measure is detachably provided in the frame portion, and the setting guide display is a tape-shaped ruler drawn from the tape measure toward the inward side of the frame portion.

According to the aspect of the invention, it is possible to precisely measure each position over the printing area on the main body by drawing the tape-shaped ruler out and using the scale display formed on the tape-shaped ruler.

Therefore, it is possible to set the precise setting position of the material to be textile-printed and to set the precise printing position of the printing image. Furthermore, by employing the structure capable of easily removing the tape measure from the frame portion after the setting work of the material to be textile-printed is completed, the ink jet textile-print process by the printing portion is not hindered.

In the tray, it is preferable that a transparent sheet-shaped member is detachably provided in the frame portion, and the setting guide display is at least either one of a scale display or a ruled line display formed on the sheet-shaped member.

In this case, the meaning of "transparent" includes colorless and transparent, colored-transparent and translucent. The sheet-shaped member may be translucent to the extent of making the position of the material to be textile-printed therebelow visible therethrough.

According to the aspect of the invention, it is possible to precisely perceive the setting position of the material to be textile-printed by employing the configuration as simple as just providing the sheet-shaped member having the scale display or ruled-line display thereon. Also, it is possible to precisely perceive the printing position of the image because the sheet-shaped member is transparent.

Furthermore, during the printing process, it is possible to simply remove the sheet-shaped member which is unnecessary at this time. Thereby, the following ink jet textile-print process is not interrupted at all.

According to another aspect of the invention, there is provided an ink jet textile-printing apparatus which executes a textile printing process by an ink jet system with respect to a material to be textile-printed set on a main body and includes the tray according to the above-described aspects of the invention.

According to the aspect of the invention, it is possible for the ink jet textile-printing apparatus to realize the operation and advantage of the aspects described above. Therefore, without regard to the size or shape of the fabric, namely the material to be textile-printed, it is possible to easily perform the setting process of the setting position of the material to be textile-printed with respect to the main body, and to precisely perceive the printing position of the image to be printed. Thereby, the printing quality of the material to be textile-printed is improved. As a result, it is possible to perform mass printing of a large number of materials to be textile-printed with the above-described specification and printing quality.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
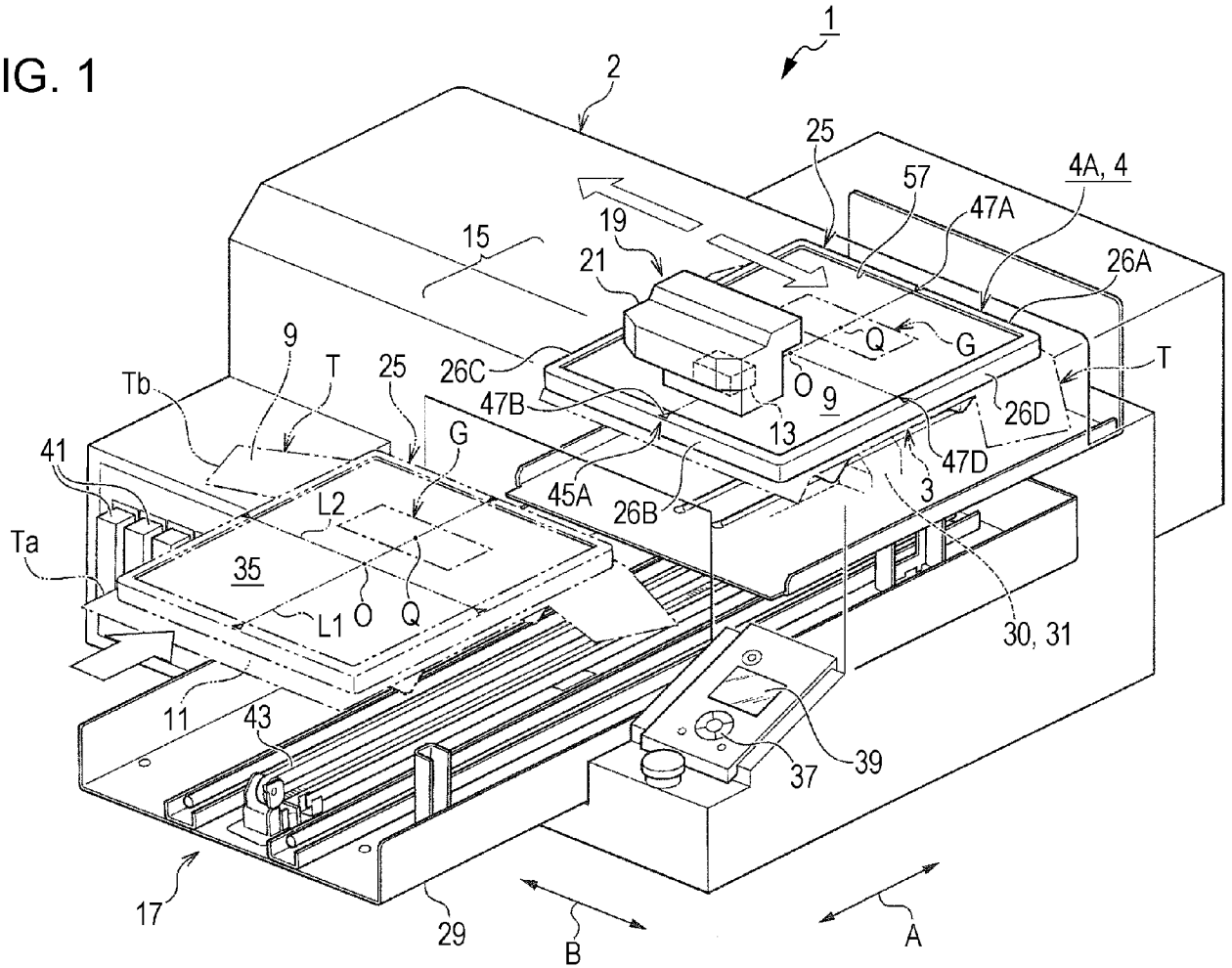
FIG. 1 is a perspective view showing a schematic configuration of an ink jet textile-printing apparatus according to an example 1 of the invention.
Figure 2:
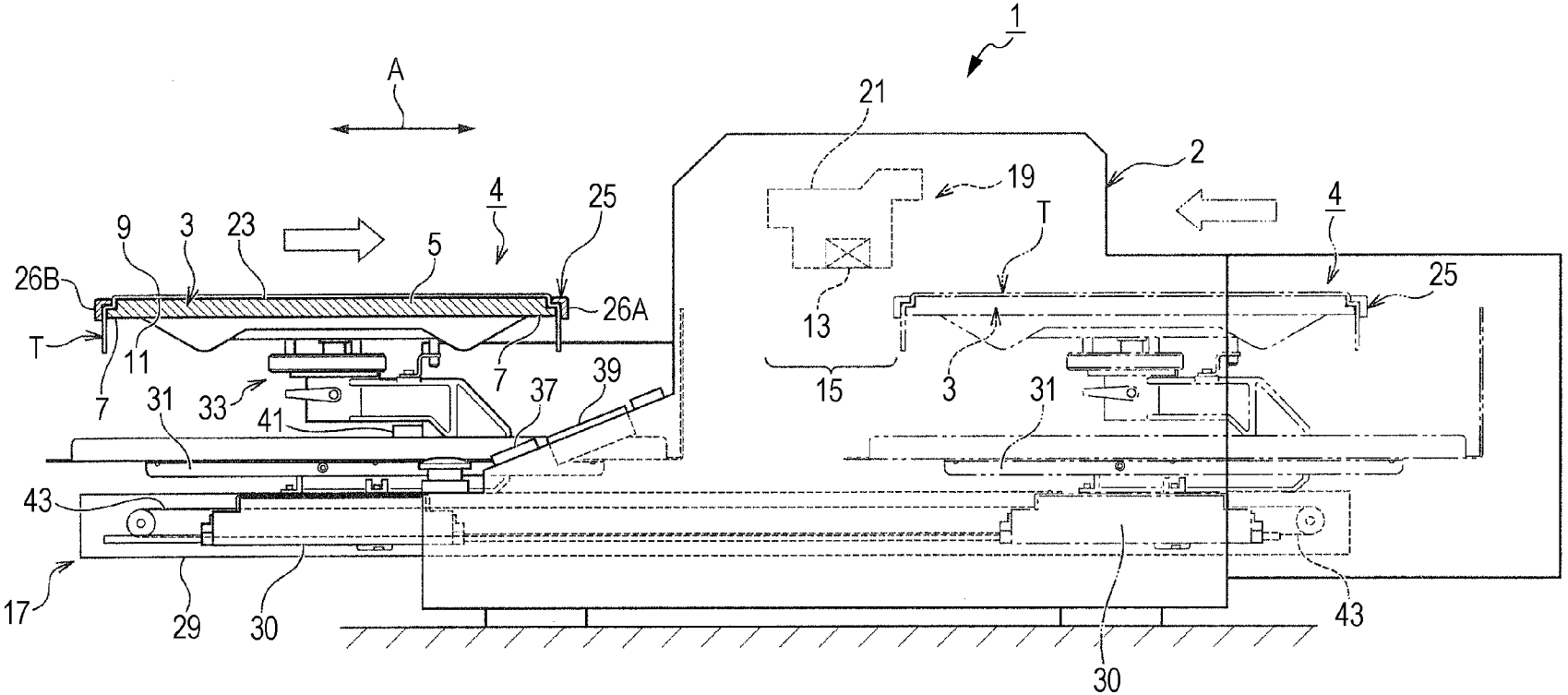
FIG. 2 is a cross-sectional side view showing the schematic configuration of the ink jet textile-printing apparatus according to the example 1.

First, an outline of the whole configuration of an ink jet textile-printing apparatus according to aspects of the invention will be described with reference to FIGS. 1 and 2. Subsequently, the configuration of a tray according to the aspect of the invention, and the procedure of a setting work of a material to be textile-printed executed by using the tray will be described in detail with reference to an example 1 shown in FIGS. 3 and 4, example 2 shown in FIG. 5, example 3 shown in FIG. 6, example 4 shown in FIGS. 7A and 7B, example 5 shown in FIG. 8 and example 6 shown in FIG. 9.

In addition, in the following description, a T-shirt of which a body portion Ta and a sleeve portion Tb are formed in a sewn manner is exemplified as a material to be textile-printed (hereinafter, referred to as "fabric") T. The front surface to be printed of the T-shirt on which a printing image G is formed is designated as a first surface 9, and the back surface to be supported on the opposite side of the first surface 9 is designated as a second surface 11.

An ink jet textile-printing apparatus 1 according to the aspect of the invention is an ink jet textile-printing apparatus executing textile-printing by an ink jet system with respect to the material to be textile-printed T set on a main body 3.

In addition, in the aspect of invention, a tray 4 described later which sets the material to be textile-printed T on a setting surface 23 of the main body 3 and fixes it at a predetermined setting position (indicated by a reference symbol O) has a characteristic feature.

Furthermore, the ink jet textile-printing apparatus 1 includes, besides the tray 4, various members constituting a transport portion 17 which transports the material to be textile-printed T held in the main body 3 using the tray 4 along a transport direction A, and various members constituting a printing portion 19 which executes the printing process by discharging ink of each color on the first surface 9 of the material to be textile-printed T introduced into a textile-print execution area 15 by the transport portion 17.

The transport portion 17 includes a support base 29 extending along the transport direction A, a support stand 31, which are integrally formed with a slider 30 reciprocating along the transport direction A, in the center portion of the support base 29 in a width direction B, and a drive mechanism equipped with a timing belt 43 which drives the support stand 31.

Furthermore, the main body 3 described later which is a constituting component of the tray 4 according to the aspect of the invention is detachably installed on the support stand 31 via a connection mechanism 33.

The printing portion 19 includes a carriage 21 reciprocating in, as a scanning direction thereof, a width direction B of an apparatus main body 2 which intersects with the transport direction A of the material to be textile-printed Transport, and an ink discharge head 13 which is mounted on the carriage 21 and executes the printing process by discharging the ink of each color toward the first surface 9 of the material to be textile-printed T located in the textile-printing execution area 15.

In addition, on a left side of the apparatus main body 2 seen from the front thereof, an ink cartridge 41 to supply the ink of each color toward the ink discharge head 13 described above which is the constituting component of the printing portion 19 is provided via an ink tube.

Furthermore, on a right side of the apparatus main body 2 seen from the front thereof, an operation button 37 to execute various operations of the ink jet textile-printing apparatus 1, and a display portion 39 to display a setting information or various of messages related to the ink jet textile-printing process are provided.

Example 1

Figure 3:
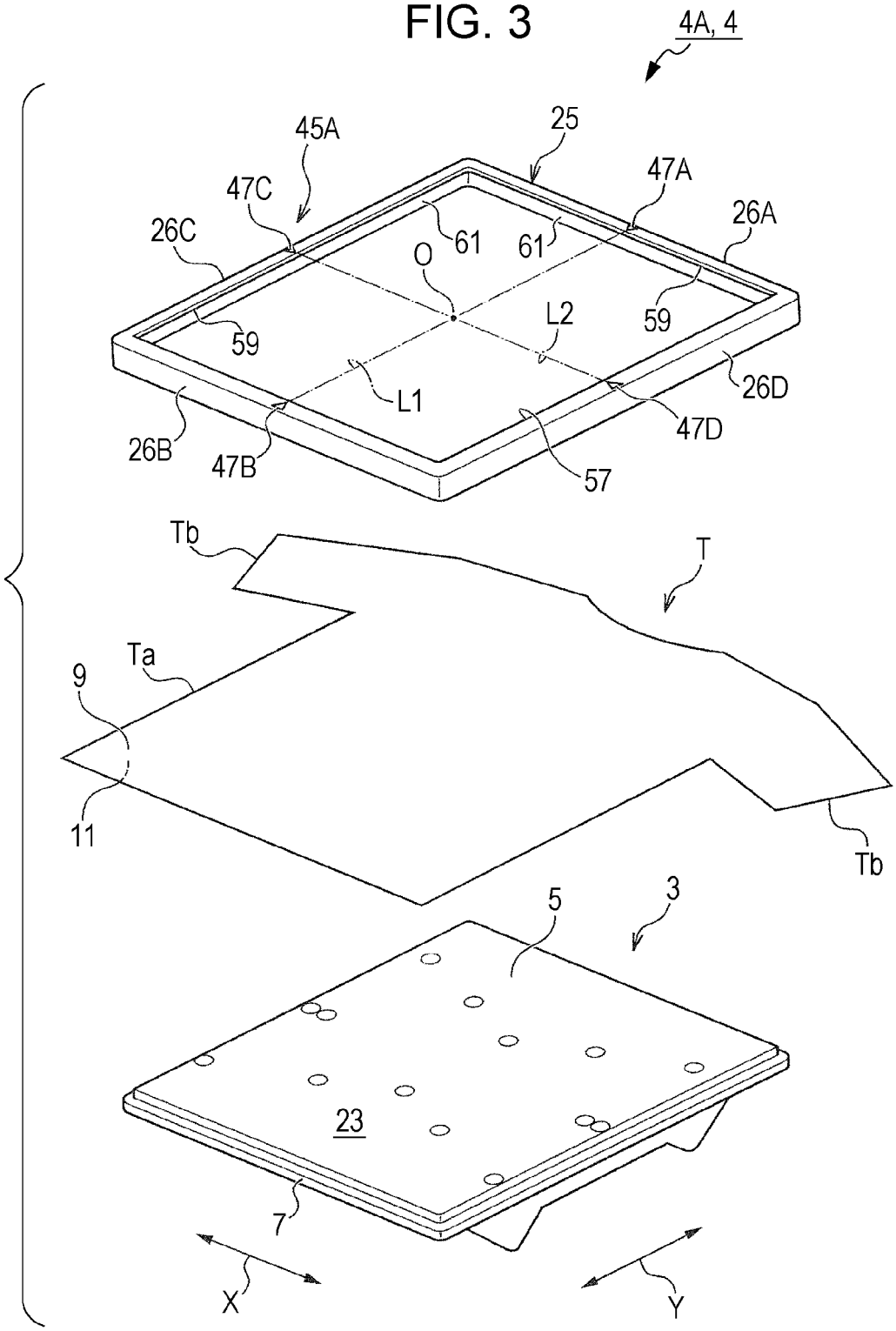
FIG. 3 is an exploded perspective view showing a tray according to the example 1.
Figure 4:
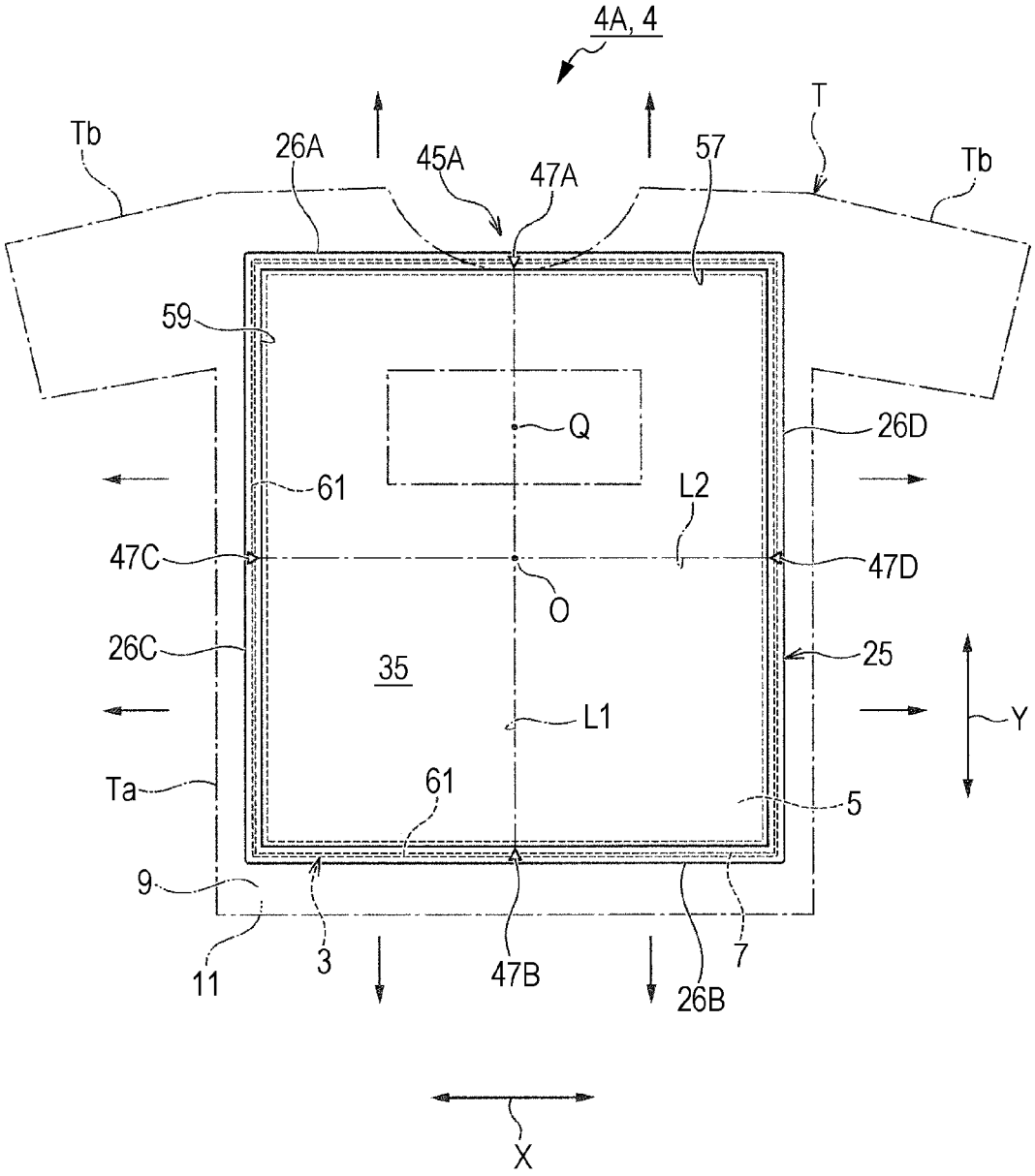
FIG. 4 is a plan view showing the tray according to the example 1.

See FIGS. 3 and 4

A tray 4A according to the example 1 includes the main body 3 to set the material to be textile-printed T, a frame portion 25 to hold, in the main body 3, the material to be textile-printed T set on the main body 3, and a setting guide display 45A. The setting guide display 45A is used as a criterion when a setting position of the material to be textile-printed T on the main body 3 is set so as to be match to the setting position O.

Furthermore, in the tray 4A of the example 1, the setting guide display 45A is constituted by a single mark 47 (47A, 47B, 47C and 47D) provided at the central position of front, rear, left and right frame elements 26A, 26B, 26C and 26D constituting the frame portion 25.

In this case, "central position of the frame elements 26A, 26B, 26C and 26D" is a middle position of each frame elements 26A, 26B, 26C and 26D in a longitudinal direction.

The main body 3 is a rectangular-plate shaped member, for example. Edge portions 7 which are formed thinner than a main body portion 5 in the center of the main body 3 and have an outer flange shape projecting outward in a horizontal direction are formed in the four surrounding sides of the main body 3. An upper surface of the main body portion 5 of the main body 3 is the setting surface 23 to support the second surface 11 of the material to be textile-printed T from therebelow.

The frame portion 25 has a window portion 57 having a rectangular window shape, for example, in which the main body portion 5 of the main body 3 fits. Also, the frame portion 25 is a rectangular-frame shaped member which is enclosed by the four frame elements 26A, 26B, 26C and 26D on the four surrounding sides thereof, and the window portion 57 is formed in the middle thereof.

Furthermore, each of the four frame elements 26A, 26B, 26C and 26D includes an inner-flange shaped step portion 59 facing the upper surface of the edge portion 7 of the main body 3 described above, and a side plate portion 61 facing a side surface of the edge portion 7 of the main body 3 described above.

The setting guide display 45A is constituted by the four single marks 47A, 47B, 47C and 47D which are respectively provided at the central positions of the four frame elements 26A, 26B, 26C and 26D, and have an equilateral triangle shape, for example. In addition, the marks 47A, 47B, 47C and 47D may be formed in various manners, such as attaching a sealing member, printing, processing irregularities or fitting of the different member.

Furthermore, in the marks 47A, 47B, 47C and 47D, an apex of the equilateral triangle thereof is disposed so as to face inwards. Thereby, an intersection point between a line L1, which connects the apexes of a pair of marks 47A and 47B facing each other, and a line L2, which connects the apexes of a pair of the other marks 47C and 47D facing each other, is configured so as to be consistent with the setting position O which is used as a reference point at the time of setting the material to be textile-printed T on the main body 3.

Next, the procedure of a setting work of a material to be textile-printed T which is executed using the tray 4A configured as above according to the example 1 will be described.

First, the material to be textile-printed T is placed on the setting surface 23 on the main body portion 5 of the main body 3. Then, the frame portion 25 is put thereon so as to be in a state where the step portion 59 and the side plate portion 61 of the frame portion 25 is lightly engaged with the edge portion 7 of the main body 3 described above.

Next, the setting position O is derived from the four marks 47A, 47B, 47C and 47D described above, and then the positioning of the material to be textile-printed T is performed through appropriately pull the circumferential edge portion thereof outwardly such that the center of the printing area 35 of the material to be textile-printed T is located at the setting position O. Also, the positional adjustment of the front, rear, left and right parts of the material to be textile-printed T is performed by using the four marks 47A, 47B, 47C and 47D as a criterion.

If the positioning of the material to be textile-printed T with respect to the setting position O is completed, the frame portion 25 is further pushed into the main body 3 side so as to be in a state where the step portion 59 and the side plate portion 61 of the frame portion 25 is completely engaged with the edge portion 7 of the main body 3. Thereby the material to be textile-printed T is firmly held in the main body 3.

As employing the tray 4A configured as above according to the example 1, it is possible to objectively and accurately perform the determination of the relative position between the material to be textile-printed T and the main body 3, which, in a related art, has been carried out by a user with their senses, using the setting guide display 45A.

Furthermore, since the setting guide display 45A of the example 1 is constituted by the single mark 47 only, the configuration is very simple. Thereby, without have to change the existing function of the main body 3 and the frame portion 25, it is possible to proceed to the following ink jet textile-printing process.

Example 2

Figure 5:
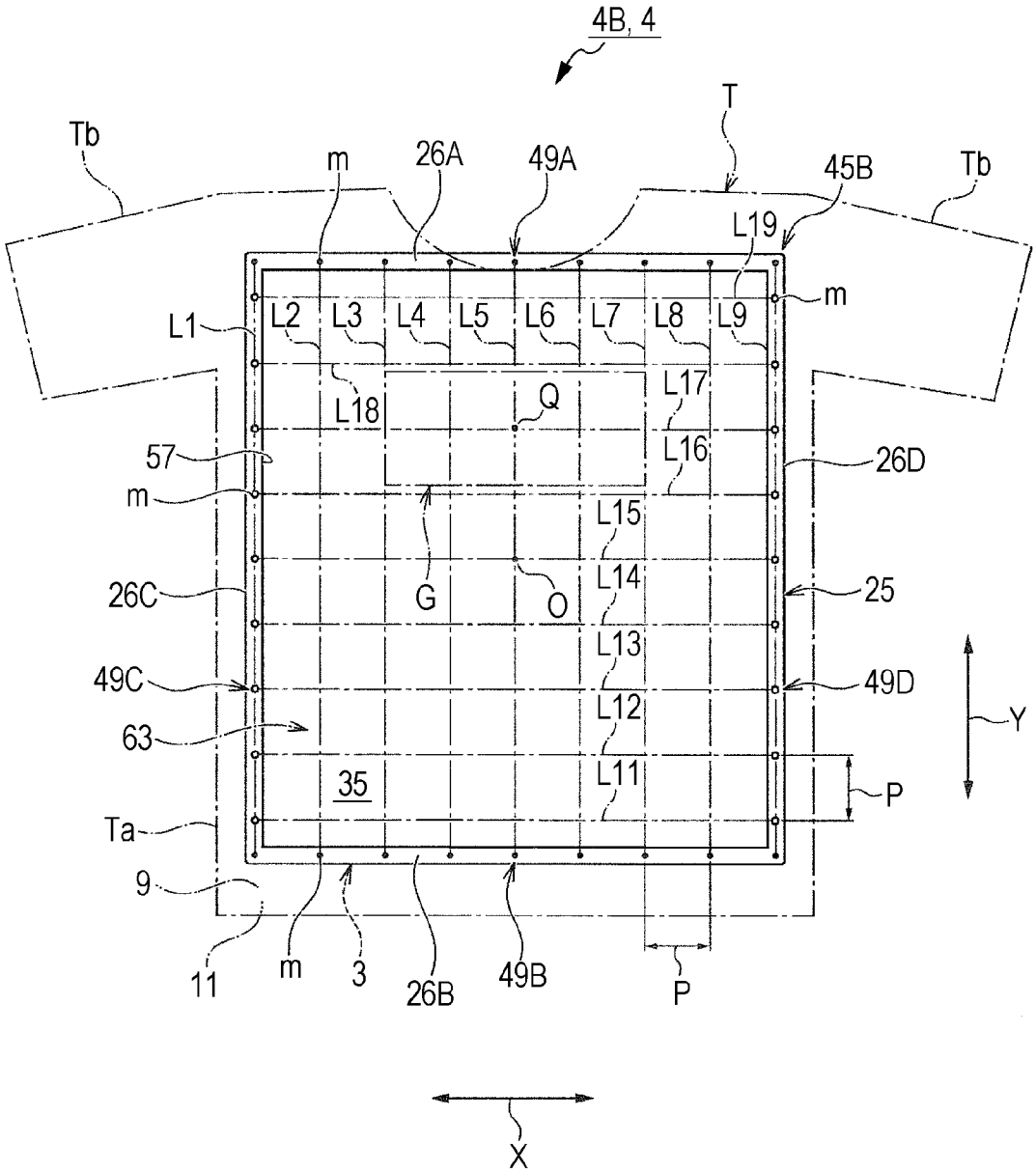
FIG. 5 is a plan view showing a tray according to an example 2 of the invention.

See FIG. 5

In a tray 4B according the example 2, the configuration of a setting guide display 45B is different from that of the setting guide display 45A of the tray 4A according to the example 1, and other configurations are the same with that of the example 1.

Therefore, the description of the same configuration as the example 1 will be omitted. Also, the configuration of the tray 4B according to the example 2, the procedure of a setting work of the material to be textile-printed T executed by using the tray 4B, and the operation and advantage of the example 2 will be described. The description focuses on the configuration of the setting guide display 45B which is different from that of the example 1.

In other words, in the example 2, the setting guide display 45B is constituted by a plurality of marks 49A, 49B, 49C and 49D which are provided at the position on the frame elements 26A, 26B, 26C and 26D where each frame element is equally divided in the longitudinal direction. Also, the front, rear, left and right frame elements 26A, 26B, 26C and 26D constitute the frame portion 25.

Furthermore, in the example 2 shown in FIG. 5, the setting guide display 45B is constituted by four groups of marks 49A, 49B, 49C and 49D. Each groups of marks 49A, 49B, 49C and 49D is formed of, for example, nine marks which divide the front, rear, left and right frame elements 26A, 26B, 26C and 26D into the same pitch P.

In addition, each of the marks 49A, 49B, 49C and 49D is constituted by, for example, an individual mark m in a circular shape. By combining lines L1 to L9, which respectively connect the individual marks m formed on the frame elements 26A and 26B facing each other, and lines L11 to L19, which respectively connect the individual marks m formed on the frame elements 26C and 26D facing each other, imaginary ruled lines 63 are formed. Therefore, the virtual ruled lines 63 vertically and horizontally divide the printing area 35 of the material to be textile-printed T into the same pitch P.

In the case of using the tray 4B configured as above according to the example 2, it is also possible to perform the setting work of the material to be textile-printed T by the same procedure as described above in the example 1. In the case of the example 2, the positioning of the material to be textile-printed T in the planar two directions thereof, which are a front-rear direction Y and a right-left direction X, and the correction of the inclination of the material to be textile-printed T are performed using the virtual ruled line 63 as a criterion. Thereby, the positioning adjustment is carried out such that the material to be textile-printed T is set at a predetermined setting position.

Furthermore, according to the example 2 configured as above, it is possible to objectively perform the determination of the relative position between the material to be textile-printed T and the main body 3, which, in a related art, has been carried out by a user with their senses, using the setting guide display 45B.

In addition, since the setting guide display 45B of the example 2 is constituted by the plurality of marks 49A, 49B, 49C and 49D, multiple determination indicators which are used as a criterion at the time of setting the setting position of the material to be textile-printed T are provided. Thereby, it is possible to more precisely perform the positioning of the material to be textile-printed T.

Example 3

Figure 6:
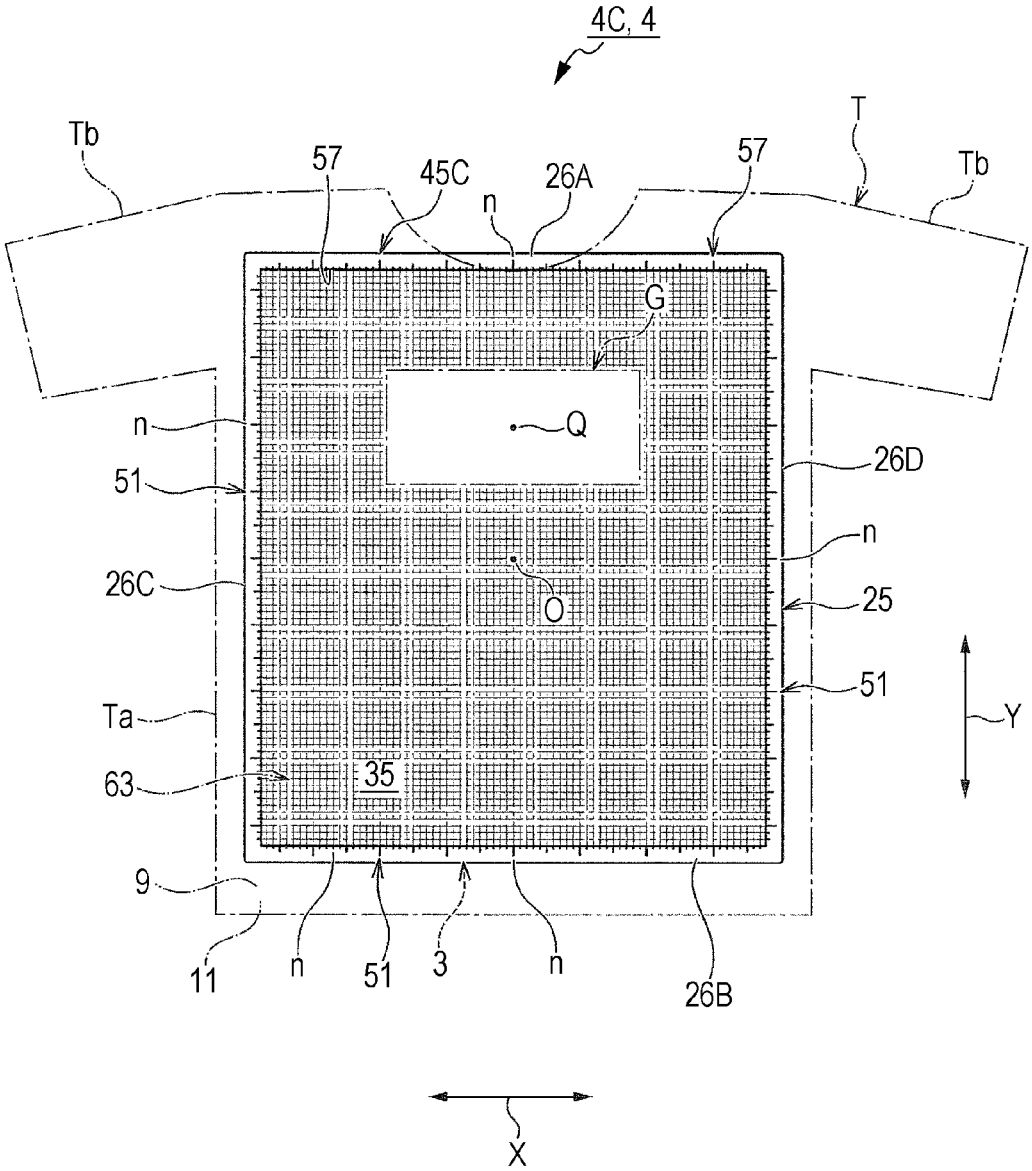
FIG. 6 is a plan view showing a tray according to an example 3 of the invention.

See FIG. 6

In a tray 4C according the example 3, the configuration of a setting guide display 45C is different from that of the setting guide display 45A of the tray 4A according to the example 1, and other configurations are the same with that of the example 1.

Therefore, the description of the same configuration as the example 1 will be omitted. Also, the configuration of the tray 4C according to the example 3, the procedure of a setting work of the material to be textile-printed T executed by using the tray 4C, and the operation and advantage of the example 3 will be described. The description focuses on the configuration of the setting guide display 45C which is different from that of the example 1.

In other words, in the example 3, the setting guide display 45C is constituted by a scale display 51 formed on the front, rear, left and right frame elements 26A, 26B, 26C and 26D, which constitute the frame portion 25, in the longitudinal direction thereof.

Furthermore, in the example 3 shown in FIG. 6, the scale display 51 having, for example, 1 mm increments is formed on each of the front, rear, left and right frame elements 26A, 26B, 26C and 26D. The virtual ruled line 63 having a fine pitch of 1 mm increments is formed through connecting the scale n formed on a pair of frame elements 26A and 263, or 26C and 26D facing each other.

In the case of using the tray 4C configured as above according to the example 3, it is also possible to perform the setting work of the material to be textile-printed T by the same procedure as described above in the example 1. In the case of the example 3, the positional deviation amount of the material to be textile-printed T in the planar two directions thereof, which are the front-rear direction Y and the right-left direction X, is measured in 1 mm increments by using the virtual ruled line 63 having a 1 mm pitch, and then the positioning of the material to be textile-printed T is performed with respect to the setting position.

Furthermore, according to the example 3 configured as above, it is possible to objectively and precisely perform the determination of the relative position between the material to be textile-printed T and the main body 3, which, in a related art, has been carried out by a user with their senses, using the setting guide display 45C.

In addition, since the setting guide display 45C of the example 3 is constituted by the scale display 51 having 1 mm increments, a mistake caused by the irregular sense of a user is reduced. Thereby, it is possible to more accurately set the setting position of the material to be textile-printed.

Example 4

Figure 7B:
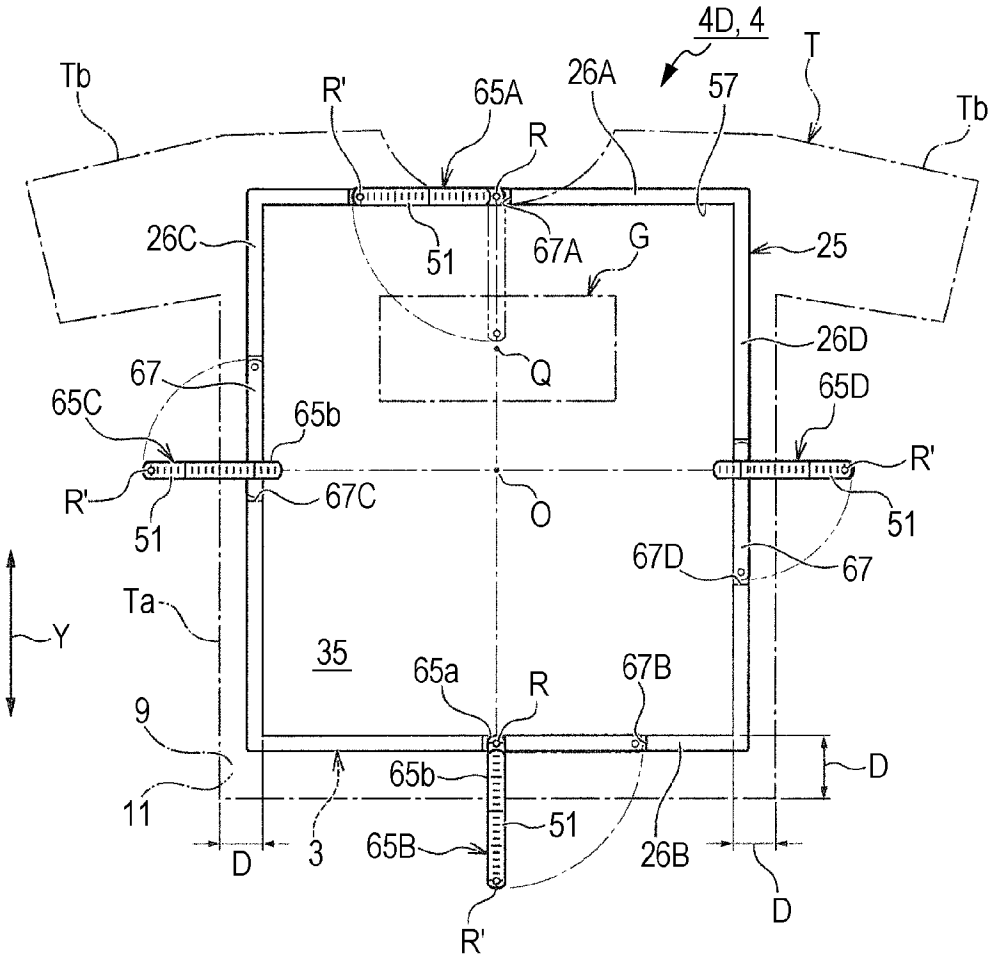
FIGS. 7A and 7B are plan views showing a tray according to an example 4 of the invention.
Figure 7A:
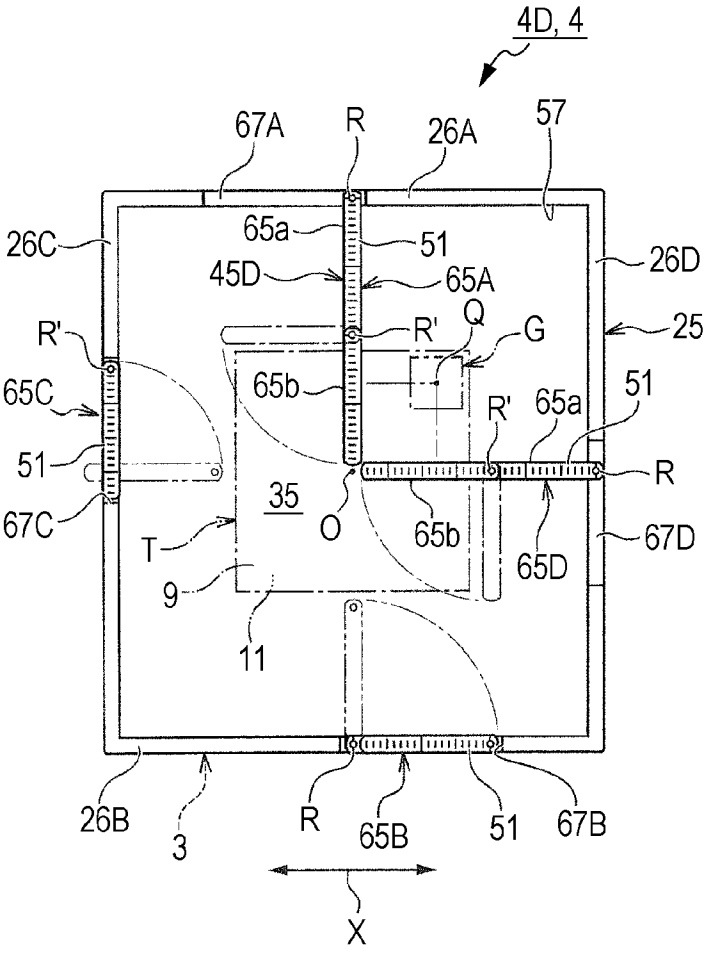

See FIGS. 7A and 7B

A tray 4D according the example 4 is different from the tray 4A according to the example 1 in that a rotary arm 65 (65A, 65B, 65C and 65D) are provided in a part of the frame portion 25, a setting guide display 45D is formed on the rotary arm 65 (65A, 65B, 65C and 65D), and the setting guide display 45D configured different than the setting guide display 45A is adopted. However, other configurations thereof are the same with that of the example 1.

Therefore, the description of the same configuration as the example 1 will be omitted. Also, the configuration of the tray 4D according to the example 4, the procedure of a setting work of the material to be textile-printed T executed by using the tray (holding structure) 4D, and the operation and advantage of the example 4 will be described. The description focuses on the configuration and operational aspects of the rotary arm 65, and the configuration and formation position of the setting guide display 45D, because both of the rotary arm 65 and the setting guide display 45D are different from the aspect of the example 1 corresponding thereto.

First, in the example 4, a recessed portion 67 (67A, 67B, 67C and 67D) is formed in a part of the frame portion 25, and the folding type rotary arms 65A, 65B, 65C and 65D are respectively provided in the recessed portions 67A, 67B, 67C and 67D so as to be engaged therewith.

Each rotary arm 65A, 65B, 65C and 65D includes a first arm 65*a* which is rotatable on the inward side and outward side of the frame portion 25 around a turning pivot point R provided in the vicinity of one corner of the recessed portions 67A, 67B, 67C and 67D, and a second arm 65*b* which is rotatably connected with a free end of the first arm 65*a* via a turning pivot point R'. Also, each rotary arm 65A, 65B, 65C and 65D configured as above is constituted by a plate shaped member having a narrow width.

In addition, in a state where the rotary arms 65A, 65B, 65C and 65D are respectively accommodated in the recessed portions 67A, 67B, 67C and 67D, the upper surface of each rotary arm 65A, 65B, 65C and 65D becomes flush with the upper surface of the other part of the frame portion 25, whereby the rotary arms 65A, 65B, 65C and 65D constitute a part of the frame portion 25.

Furthermore, the scale display 51 as the setting guide display 45D is formed on the rotary arms 65A, 65B, 65C and 65D along the longitudinal direction thereof.

In addition, in the example 4 shown in FIGS. 7A and 7B, for example, the recessed portions 67A, 67B, 67C and 67D are respectively formed on the front, rear, left and right frame elements 26A, 26B, 26C and 26D constituting the frame portion 25. Also, the four rotary arms 65A, 65B, 65C and 65D are respectively attached to the recessed portions 67A, 67B, 67C and 67D.

In the case of using the tray 4D configured as above according to the example 4, when the size of the material to be textile-printed T is smaller than that of the main body 3, the rotary arm 65 is rotated on the inward side of the frame portion 25 as shown in FIG. 7A, and then the positioning of the material to be textile-printed with respect to the setting position O is performed using the scale display 51 formed on the rotary arm 65. Furthermore, in this case, the positioning process is performed using a temporary fabric or the like to fill the gap between the frame portion 25 and the edge portion 7 of the main body 3 so as to fix the position thereof.

On the other hands, when the size of the material to be textile-printed T is bigger than that of the main body 3, the rotary arm 65 is rotated on the outward side of the frame portion 25 as shown in FIG. 7B, and then the positioning of the material to be textile-printed with respect to the setting position O is performed in a manner of measuring protrusion amounts D of the material to be textile-printed T in four directions of front, rear left and right sides by using the scale display 51 formed on the rotary arm 65.

According to the example 4 configured as above, it is also possible to objectively and precisely perform the determination of the relative position between the material to be textile-printed T and the main body 3, which, in a related art, has been carried out by a user with their senses, using the setting guide display 45D formed on the rotary arm 65.

Furthermore, in the case of the example 4, it is possible to cope with the material to be textile-printed T having a bigger or smaller size than that of main body 3. Therefore, it is possible to provide the tray 4D capable of coping with the material to be textile-printed having a various sizes or shapes. In addition, by using the rotary arm 65 and the scale display 51 formed on the rotary arm 65, it is also possible to be used at the time of setting a printing position Q of the printing image G to be printed.

Example 5

Figure 8:
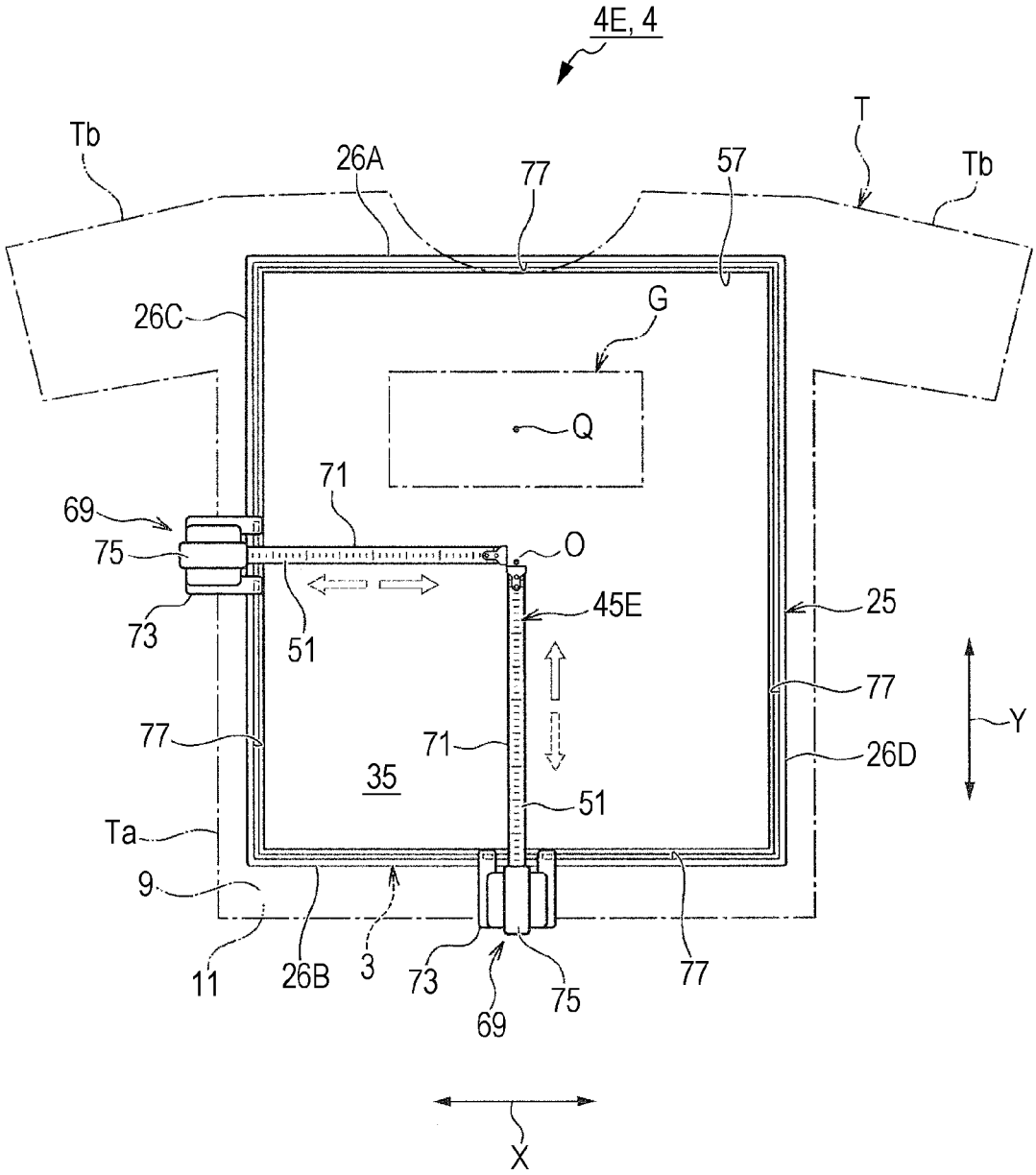
FIG. 8 is a plan view showing a tray according to an example 5 of the invention.

See FIG. 8

A tray 4E according the example 5 is different from the tray 4A according to the example 1 in that a tape measure 69 is detachably provided in the frame portion 25, a setting guide display 45E is formed on a tape-shaped ruler 71 of the tape measure 69, and the setting guide display 45E configured different than the setting guide display 45A is adopted. However, other configurations thereof are the same with that of the example 1.

Therefore, the description of the same configuration as the example 1 will be omitted. Also, the configuration of the tray 4E according to the example 5, the procedure of a setting work of the material to be textile-printed T executed by using the tray (holding structure) 4E, and the operation and advantage of the example 5 will be described. The description focuses on the configuration and operational aspects of the tape measure 69, and the configuration and formation position of the setting guide display 45E, because both of the tape measure 69 and the setting guide display 45E are different from the aspect of the example 1 corresponding thereto.

In other words, in the example 5, a guide groove 77 is formed on the upper and lower surfaces of the frame portion 25, and a holder portion 73 engaged with the guide groove 77 is detachably provided. In addition, the tape measure 69 of which a housing 75 accommodates the tape-shaped ruler 71 in a wound state is mounted on the holder portion 73. Furthermore, the setting guide display 45E is formed by forming the scale display 51 on the tape-shaped ruler 71. Additionally, in the example 5, the guide groove 77 is formed on all of the four frame elements 26A, 26B, 26C and 26D, and two tape measures 69, 69 are respectively installed on the guide grooves 77, 77 of the two frame elements 26, 26 arbitrary selected from the four frame elements.

In the case of using the tray 4E configured as above according to the example 5, first, preparation for measuring is carried by mounting the tape measure 69 on the holder portion 73 and installing the holder portion 73 on the guide groove 77.

Next, the tape-shaped ruler 71 is drawn out from the tape measure 69 installed on the frame portion 25, and then the current location of the material to be textile-printed T is measured based on the position of the collar, pocket or the like by using the scale display 51, namely the setting guide display 45E, formed on the tape-shaped ruler 71. Subsequently, the positioning process is performed such that the material to be textile-printed T is located at the predetermined setting position.

Incidentally, the tape measure 69 installed on the frame portion 25 is removed after the setting process for the setting position of the material to be textile-printed T is completed, and then the process proceeds to the following ink jet textile-printing process.

According to the example 5 configured as above, it is also possible to objectively and precisely perform the determination of the relative position between the material to be textile-printed T and the main body 3, which, in a related art, has been carried out by a user with their senses, using the setting guide display 45E formed on the tape-shaped ruler 71.

In addition, in the case of the example 5, it is possible to precisely measure each position over the printing area 35 on the main body 3 by using the scale display 51, whereby it is possible to set the precise setting position of the material to be textile-printed T and to set the precise printing position Q of the printing image G.

Furthermore, since it is possible to easily removing the tape measure 69 from the frame portion 25 after the setting work of the material to be textile-printed T is completed, the ink jet textile-print process by the printing portion 19 is not hindered.

Example 6

Figure 9:
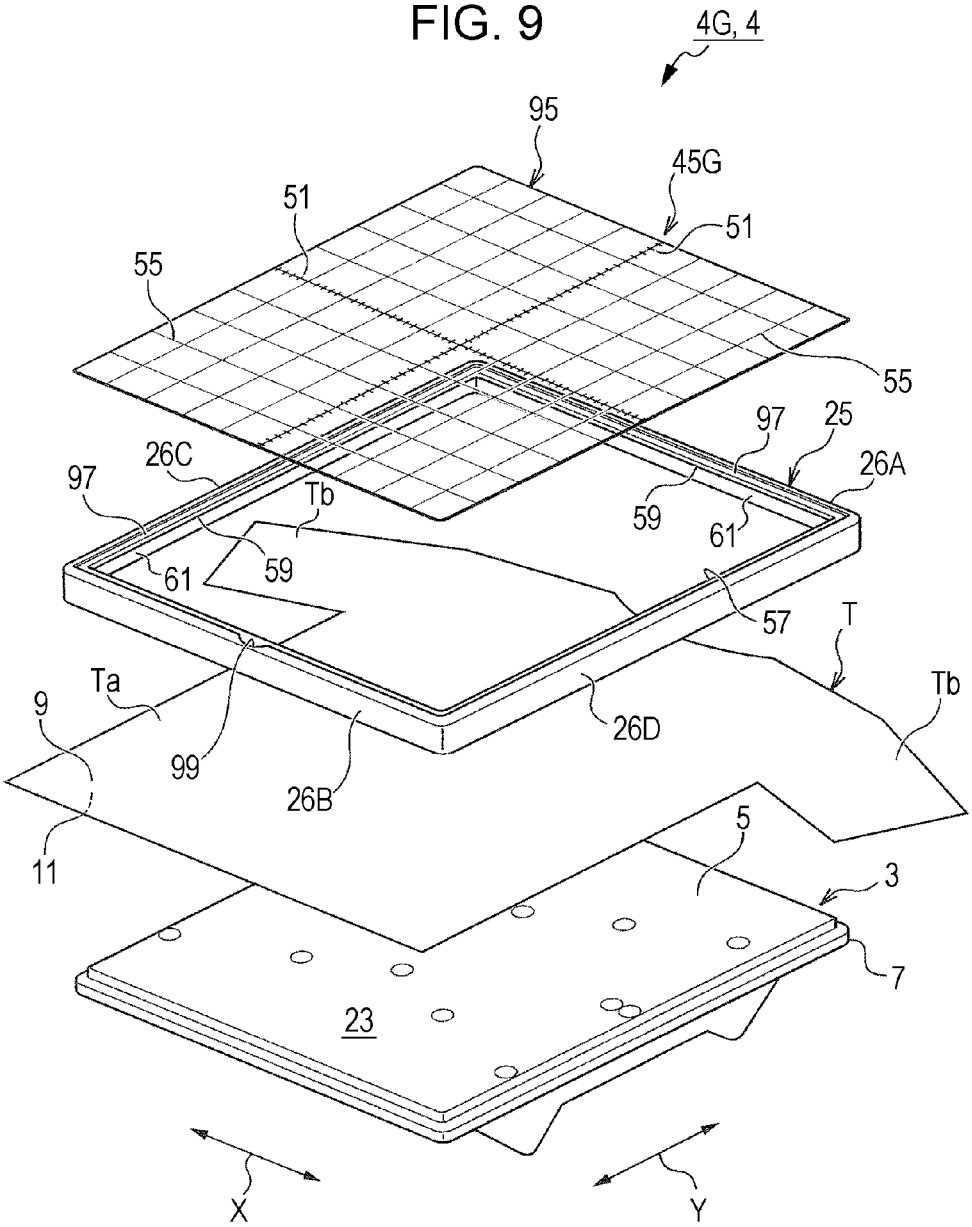
FIG. 9 is an exploded perspective view showing a tray according to the example 6.

See FIG. 9

A tray 4G according the example 6 is different from the tray 4A according to the example 1 in that a sheet-shaped member 95 is detachably provided in the frame portion 25, and the configuration and formation position of the setting guide display 45G is different from the aspect of the example 1 corresponding thereto. However, other configurations are the same with that of the example 1.

Therefore, the description of the same configuration as the example 1 will be omitted. Also, the configuration of the tray 4G according to the example 6, the procedure of a setting work of the material to be textile-printed T executed by using the tray (holding structure) 4G, and the operation and advantage of the example 6 will be described. The description focuses on the configuration and operational aspects of the sheet-shaped member 95, and the configuration and formation position of the setting guide display 45G because both of the sheet-shaped member 95 and the setting guide display 45G are different from the aspect of the example 1 corresponding thereto.

In other words, in the example 6, the sheet-shaped member 95 having a transparency property which is able to be detachably attached to the frame portion 25 is used. A transparent synthetic resin film or thin synthetic resin plate is used as the sheet-shaped member 95 having a transparency property. In the example shown in FIG. 9, a positioning concave 97 is formed on the upper surface of the frame portion 25 to install the sheet-shaped member 95. In this case, the meaning of "transparent" includes colorless and transparent, colored-transparent and translucent. The sheet-shaped member 95 may be translucent to the extent of making the position of the material to be textile-printed T therebelow visible therethrough.

Also, the scale display 51 and a ruled-line display 55, as the setting guide display 45G, are formed on the sheet-shaped member 95. The structure provided with either one of these displays 51, 55 may be possible.

In the case of using the tray 4G configured as above according to the example 6, first, preparation for measuring is carried by fitting the sheet-shaped member 95 in the positioning concave 97 formed on the upper surface of the frame portion 25.

Next, the current location of the material to be textile-printed T is measured using the setting guide display 45G formed on the sheet-shaped member 95 set thereon, and then the positioning process is performed based on the measured current position of the material to be textile-printed T such that the material to be textile-printed T is located at the predetermined setting position.

Incidentally, after the setting process for the setting position of the material to be textile-printed T is completed, the sheet-shaped member 95 is removed upwardly by putting user's finger into the sheet-shaped member 95 using a finger putting portion 99 formed in a part of the positioning concave 97 on the upper surface of the frame portion 25. Subsequently, the process proceeds to the following ink jet textile-printing process.

According to the example 6 configured as above, it is also possible to objectively and precisely perform the determination of the relative position between the material to be textile-printed T and the main body 3, which, in a related art, has been carried out by a user with their senses, using the setting guide display 45G formed on the sheet-shaped member 95.

In addition, in the case of the example 6, it is possible to measure each position over the printing area 35 on the main body 3 by using the scale display 51 and ruled-line display 55 formed on the sheet-shaped member 95, whereby it is possible to set the precise setting position of the material to be textile-printed T and to set the precise printing position Q of the printing image G.

Furthermore, since it is possible to easily removing the sheet-shaped member 95 from the frame portion 25 after the setting work of the material to be textile-printed T is completed, the ink jet textile-print process by the printing portion 19 is not hindered.

Other Example

Although the tray 4 and the ink jet textile-printing apparatus 1 according to aspects of the invention basically have the configuration described above, it is also possible to partially change or omit the configuration unless departing from the scope of the invention.

Modification Example of Example 1

In the description of the examples described above, the shape of the main body 3 of the tray 4 and the frame portion 25 is rectangular. However, without being limited thereto, various shapes such as circular, triangular, pentagonal, hexagonal may be also available.

Figure 10:
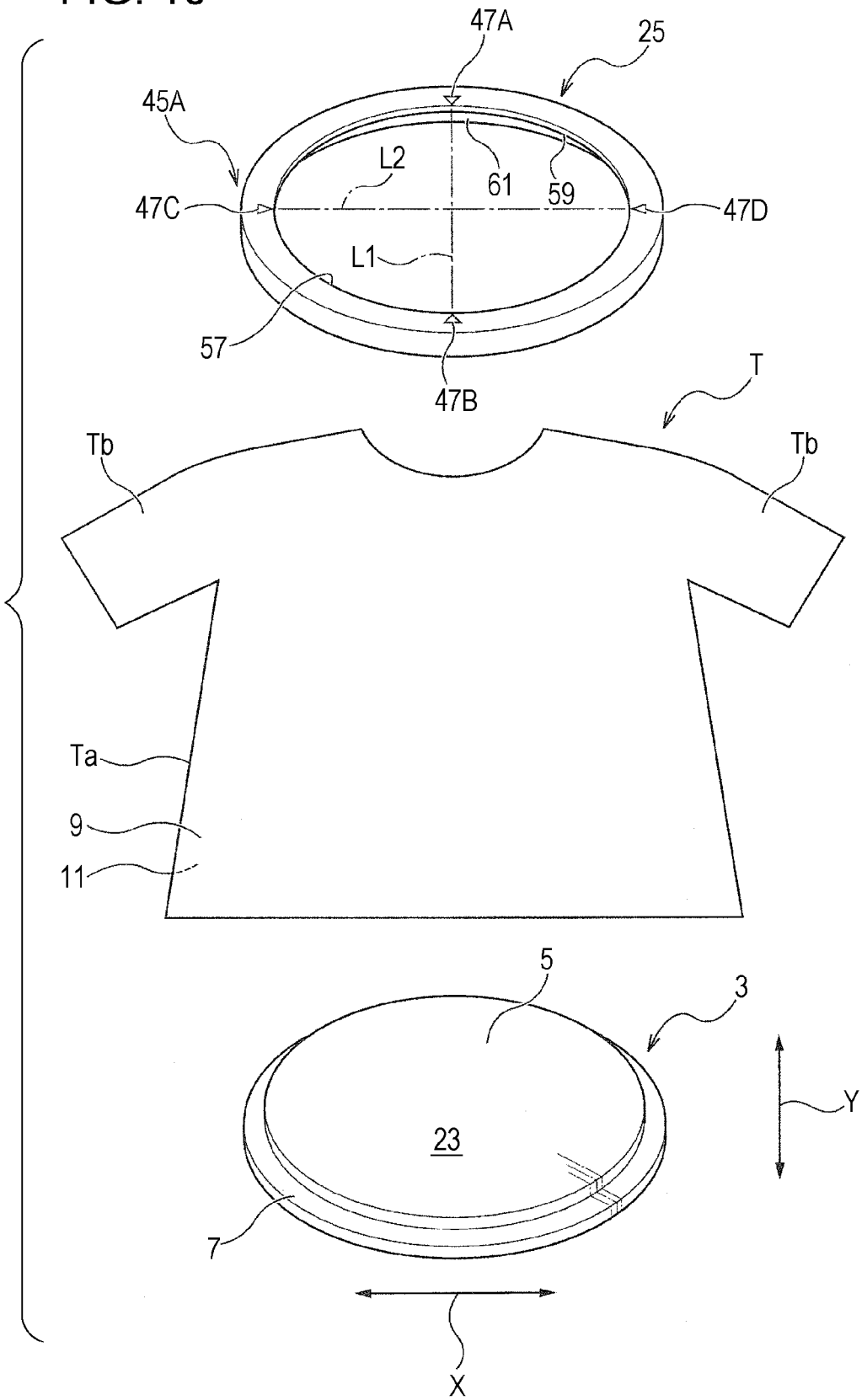
FIG. 10 is an exploded perspective view showing a tray according to a modification example of the example 1 of the invention.

As a modification example of the example 1, the circular-shaped tray 4 is shown in FIG. 10. In other words, the shape of the main body 3 is circular and the shape of the frame portion 25 corresponding thereto is also circular.

The setting guide display 45A, which is used as a criterion when a setting position of the material to be textile-printed T on the main body 3 is set so as to be match to the setting position O, is provided in the circular-shaped frame portion 25. In the modification example, the setting guide display 45A is constituted by the four marks 47 (47A, 47B, 47C and 47D) provided at the position where the circular-shaped frame portion 25 is equally divide in four in the circumferential direction.

The main body 3 is a circular plate-shaped member as well. Edge portion 7 which is formed thinner than the main body portion 5 in the center of the main body 3 and has an outer flange shape projecting outward in the horizontal direction is formed in the circumferential edge portion of the main body 3.

In addition, the upper surface of the main body portion 5 of the main body 3 is the setting surface 23 to support the second surface 11 of the material to be textile-printed T therebelow.

The frame portion 25 includes the window portion 57 having a circular shape in which the main body portion 5 of the main body 3 is fit, the inner-flange shaped step portion 59 facing the upper surface of the edge portion 7 of the main body 3 described above, and the side plate portion 61 facing the side surface of the edge portion 7 of the main body 3 described above.

According to the modification example, an operational advantage thereof is almost the same as that of the example 1.

Furthermore, it is possible for the trays 4A to 4G described in the examples 1 to 6 to be used in a single state or an appropriately combined state. Also, the rotary arm 65 of the example 4 and the tape measure 69 of the example 5 may be mounted on or provided in each of the frame elements 26A, 26B, 26C and 26D, or may be mounted on or provided in some of the frame elements 26.

In addition, it is possible to apply various shapes, colors, structures or sizes to the mark 47, 49 of the example 1 and example 2. Also, it is possible to use the different kinds of mark 47, 49 in an appropriately combined state.

The entire disclosure of Japanese Patent Application No. 2012-094524, filed Apr. 18, 2012 is expressly incorporated by reference herein.

What is claimed is:

1. A tray comprising:

a main body to set a material to be textile-printed; and a frame portion that is fit in the main body in a state of setting the material to be textile-printed thereon and maintains the setting state of the material to be textile-printed; wherein the main body includes an edge portion that is thinner than a center of the main body, the frame portion includes a step portion that is configured to face an upper surface of the edge portion, and a setting guide display that is used as a criterion for determining a setting position of the material to be textile-printed on the main body, wherein the setting guide display is formed on an upper surface of the step portion.

2. The tray according to claim 1, wherein the frame portion includes a plurality of setting guide displays.

3. The tray according to claim 2, wherein, in the plurality of setting guide displays, at least two setting guide displays are provided in the frame portion so as to face each other.

4. The tray according to claim 2, wherein the frame portion has a plurality of frame elements constituting the frame portion, and wherein the setting guide display is provided at a central position of each frame element.

5. The tray according to claim 2, wherein the frame portion has the plurality of frame elements constituting the frame portion, and wherein the setting guide display is provided at the position on the frame element where the frame element is equally divided in a predetermined direction.

6. The tray according to claim 1, wherein the setting guide display is a scale display formed on the frame portion.

7. The tray according to claim 1, wherein a rotary arm capable of rotating on an inward side and outward side of the frame portion is provided in the frame portion, and wherein the setting guide display is a scale display formed on the rotary arm.

8. The tray according to claim 1, wherein a tape measure is detachably provided in the frame portion, and wherein the setting guide display is a tape-shaped ruler drawn from the tape measure toward the inward side of the frame portion.

9. The tray according to claim 1, wherein a transparent sheet-shaped member is detachably provided in the frame portion, and wherein the setting guide display is at least either one of a scale display or a ruled line display formed on the sheet-shaped member.

10. An ink jet textile-printing apparatus that executes a textile printing process by an ink jet system with respect to a material to be textile-printed set on a main body comprising, the tray according to claim 1.

11. An ink jet textile-printing apparatus that executes a textile printing process by an ink jet system with respect to a material to be textile-printed set on a main body comprising, the tray according to claim 2.

12. An ink jet textile-printing apparatus that executes a textile printing process by an ink jet system with respect to a material to be textile-printed set on a main body comprising, the tray according to claim 3.

13. An ink jet textile-printing apparatus that executes a textile printing process by an ink jet system with respect to a material to be textile-printed set on a main body comprising, the tray according to claim 4.

14. An ink jet textile-printing apparatus that executes a textile printing process by an ink jet system with respect to a material to be textile-printed set on a main body comprising, the tray according to claim 5.

15. An ink jet textile-printing apparatus that executes a textile printing process by an ink jet system with respect to a material to be textile-printed set on a main body comprising, the tray according to claim 6.

16. An ink jet textile-printing apparatus that executes a textile printing process by an ink jet system with respect to a material to be textile-printed set on a main body comprising, the tray according to claim 7.

17. An ink jet textile-printing apparatus that executes a textile printing process by an ink jet system with respect to a material to be textile-printed set on a main body comprising, the tray according to claim 8.

18. An ink jet textile-printing apparatus that executes a textile printing process by an ink jet system with respect to a material to be textile-printed set on a main body comprising, the tray according to claim 9.

19. The tray according to claim 1, wherein a shape of the setting guide display is triangle.

20. The tray according to claim 1, wherein the setting guide display is formed by attaching a sealing member.

21. The tray according to claim 1, wherein the setting guide display is formed by processing irregularities.

22. The tray according to claim 1, wherein the setting guide display is formed by fitting a different member.

* * * * *